US007473189B2

(12) United States Patent
Schweigert et al.

(10) Patent No.: US 7,473,189 B2
(45) Date of Patent: Jan. 6, 2009

(54) METHODS AND APPARATUS FOR A TOE-UP PUTTER CLUB HEAD

(75) Inventors: Bradley D. Schweigert, Glendale, AZ (US); John K. Solheim, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 11/796,671

(22) Filed: Apr. 27, 2007

(65) Prior Publication Data

US 2007/0265110 A1 Nov. 15, 2007

Related U.S. Application Data

(63) Continuation of application No. 10/650,289, filed on Aug. 28, 2003, now abandoned.

(51) Int. Cl.
*A63B 53/04* (2006.01)

(52) U.S. Cl. ..... 473/341; 473/350

(58) Field of Classification Search ..... None
See application file for complete search history.

(56) References Cited

U.S. PATENT DOCUMENTS 5,795,239 A * 8/1998 Lin ..... 473/255
2004/0038746 A1* 2/2004 Wahl et al. ..... 473/340
2004/0171433 A1* 9/2004 Ashton ..... 473/251

FOREIGN PATENT DOCUMENTS

| | | | |
|---|---|---|---|
| GB | 2304591 A | * | 3/1997 |
| GB | 2 334 454 A | | 8/1999 |
| JP | 09051966 A | * | 2/1997 |
| WO | WO 84/03447 | | 9/1984 |

* cited by examiner

*Primary Examiner*—Gene Kim
*Assistant Examiner*—Alvin A Hunter

(57) ABSTRACT

A club head is configured such that the toe thickness is greater than the heel thickness in order to compensate for the toe-down look encountered, for example, in extended-length putters. In accordance with a further aspect of the present invention, the club head body in the heel region is weight-compensated to substantially balance with the toe region. In accordance with one embodiment, a bore configured to accept the shaft is provided at substantially the center of the top rail. In accordance with one embodiment, cut-out regions are provided in the back of the club head body in the toe region and the heel region to provide the required weight compensation.

22 Claims, 2 Drawing Sheets

METHODS AND APPARATUS FOR A TOE-UP PUTTER CLUB HEAD

CROSS REFERENCE TO RELATED APPLICATIONS

This application is a continuation application of U.S. patent application Ser. No. 10/650,289, filed Aug. 28, 2003 now abandoned.

FIELD OF INVENTION

The present invention relates, generally, golf club heads and, more particularly, to an improved putter club head for use with, for example, extended-length putters A golfer's ability to properly line up a ball with the club head to produce the desired ball path is largely a function of the various visual cues provided to the golfer by the club head during and after address. This is particularly the case with putting, where the golfer's address and stroke direction are highly influenced by psychological and visual factors.

BACKGROUND OF THE INVENTION

While putter club heads are typically designed such that the sole of the putter, during proper address, rests square with respect to the ground, it is known that golfers often roll the golf club head slightly forward onto the toe during address. This practice is especially prevalent with extended length or "long" putters. When the club is rolled forward onto the toe, the shaft is more vertical, and the golfer is positioned more directly over the ball.

Golf club design is strictly governed by various national and international standards, one of which specifies that the club's shaft must have a minimum angle (e.g., about 10 degrees) with respect to the club head body. This prevents club manufacturers from producing putters that can act as simple pendulums when held directly over the ball.

In prior art putters, when the golfer positions the club so that the shaft is more vertical, the toe of the club head is necessarily lower than the heel of the club head. The visual effect of this height difference can be distracting to the golfer, and can prevent the golfer from achieving proper address and swing direction.

SUMMARY OF THE INVENTION

The present invention generally provides a putter club head configured such that the toe thickness is greater than the heel thickness, thus compensating for the toe-down look encountered, for example, in extended-length putters. In accordance with a further aspect of the present invention, the club head body in the heel region is weight-compensated to substantially balance with the toe region. In accordance with one embodiment, cut-out regions are provided in the back of the club head body in the toe region and the heel region to provide the required weight compensation. In accordance with another embodiment of the present invention, a bore configured to accept the shaft is provided on the top rail at approximately the midpoint between the toe and heel regions.

BRIEF DESCRIPTION OF THE DRAWINGS

The subject invention will hereinafter be described in conjunction with the appended drawing figures, wherein like numerals denote like elements, and.

DETAILED DESCRIPTION

The present invention generally provides a club head body with an upwardly sloping toe region having a thickness greater than the heel thickness, thereby compensating for the toe-down look encountered in many putters, particularly extended-length putters.

Figure 1A:
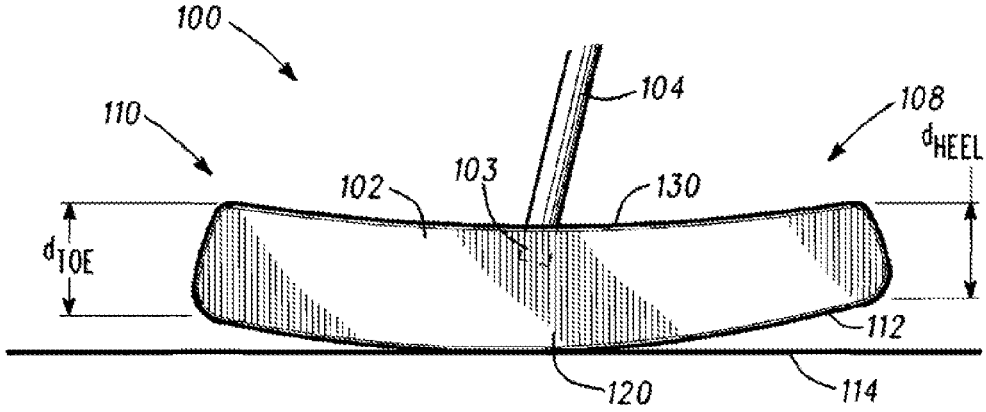
FIGS. 1A and 1B are front views of a putter club head in accordance with one embodiment of the present invention.

Referring to FIG. 1A, a club head 100 in accordance with one embodiment of the present invention comprises a body 102 having a toe region 110, a heel region 108, a sole 112, a face (or "striking surface") 120, and a top surface (or "top rail") 130 generally opposite said sole 112. A hosel or, as illustrated, a bore 103 is configured to accept a shaft 104. In one embodiment, bore 103 is located at substantially the midpoint between toe region 110 and heel region 108. In this regard, while the illustrated embodiment is described in the context of a bore 103 provided within body 102, the present invention contemplates any suitable hosel, bore, or other attachment method that mechanically couples shaft 104 to body 102. In the interest of brevity, the term "hosel" may be used herein to designate any such attachment method.

In the illustrated embodiment, toe region 110 is characterized by a toe thickness $d_{toe}$, and heel region 108 is characterized by a heel thickness $d_{heel}$. These thicknesses are suitably defined by the distances between sole 112 and top surface 130 at heel region 108 and toe region 110 respectively.

Figure 1B:
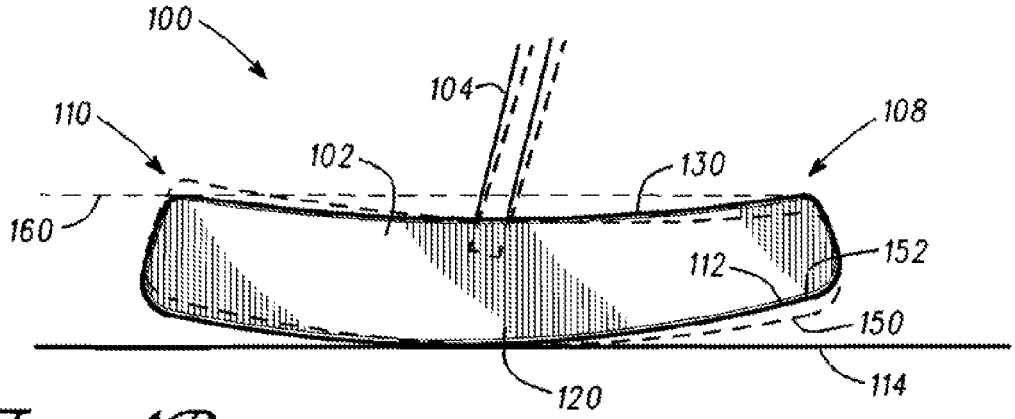

As shown in FIG. 1A, when club head 100 is positioned such that sole 112 is level (or symmetrical about its midpoint) with respect to reference 114, toe region 110 is farther from reference 114 (i.e., closer to the golfer's hands), and heel region 108 is closer to reference 114 (i.e., farther from the golfer's hands). When club head 100 is rolled forward such that sole 112 contacts reference 114 closer to toe region 110 (i.e., when shaft 104 is held more upright), the position of body 102, and consequently top surface 130, changes significantly. More particularly, referring now to FIG. 1B, when club head 100 is rolled forward, sole 112 rotates from a first position 150 to a second position 152, and top surface 130 changes position accordingly, giving the appearance of a level top surface extending along a line 160 that is substantially parallel to reference 114.

Referring again to FIG. 1A, a club head 100 in accordance with one aspect of the present invention is characterized by a toe thickness $d_{toe}$ equal to heel thickness $d_{heel}$ multiplied by a toe-up factor k. In the illustrated embodiment, for example (which is not necessarily to scale), toe-up factor k is between approximately 1.20 and 1.40, preferably about 1.3. The present invention comprehends any suitable toe-up factor, and may be selected based on any number of design factors, including, for example, the curvature of surfaces 112 and/or 130, the length of shaft 104, the position of hosel or bore 103 with respect to body 102, and the length of body 102.

Top surface 130 may be of any suitable shape, width, and length. In one embodiment, surface 130 is generally concave (when viewing face 120 from the front as shown in FIG. 1A), and has a radius of curvature greater than or equal to that of sole 112. The present invention, however, is not so limited, and contemplates any suitable club head shape.

In accordance with a further aspect of the present invention, the club head body in said heel region is weight-compensated to substantially balance with said toe region. That is, to the extent that body 102 in toe region 110 is generally thicker than body 102 in heel region 108, it is desirable to compensate for any resulting imbalances in club head 100.

Weight-compensation may be achieved in a number of ways. For example, weights, inserts, or added material may be incorporated into heel region 108, either internally (e.g., high-density inserts) or externally. Conversely, material may be removed from body 102 in toe region 110. In accordance with one embodiment, cut-out regions are provided in the back of the club head body in the toe region and the heel region. The respective geometries of these inserts are selected to provide the required weight compensation. In this regard, club head 102 may be manufactured using any suitable materials, including various metals, plastics, ceramics, or a combination thereof. In one embodiment, club head body 120 comprises a contiguous metal material, e.g., a dense titanium alloy.

Figure 2:
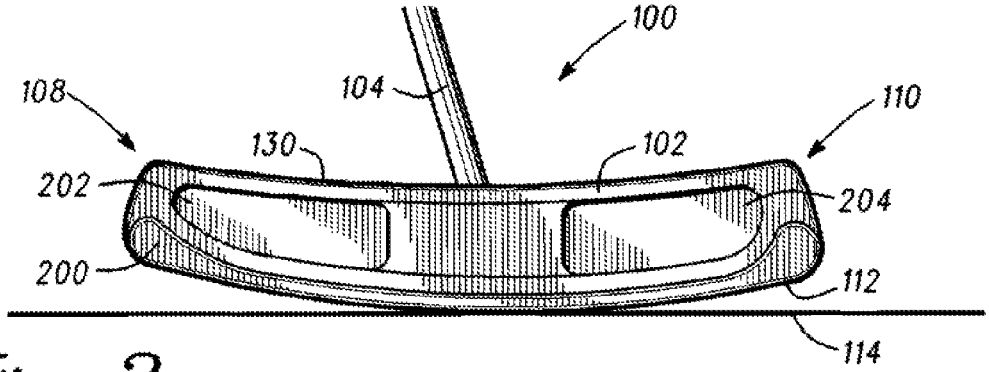
FIG. 2 is a back view of the putter club head shown in FIG. 1.
Figure 3:
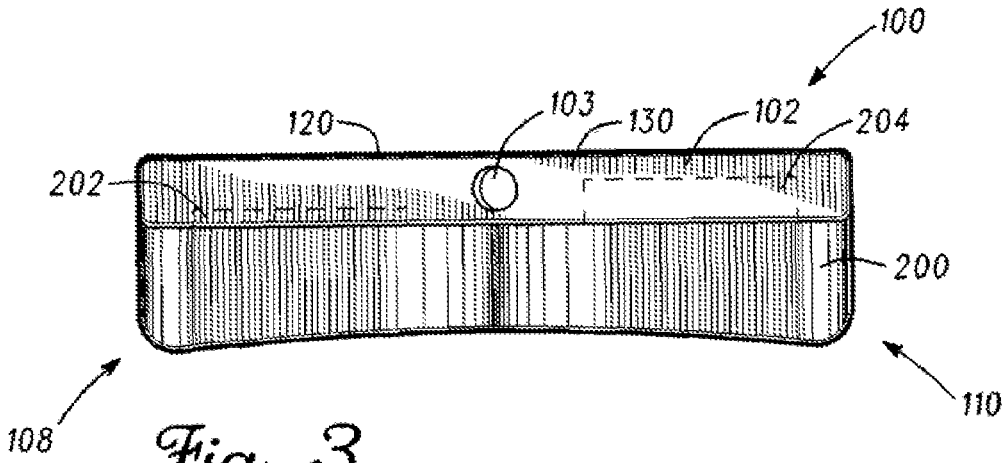
FIG. 3 is a top view of the putter club head shown in FIG. 1.
Figure 4:
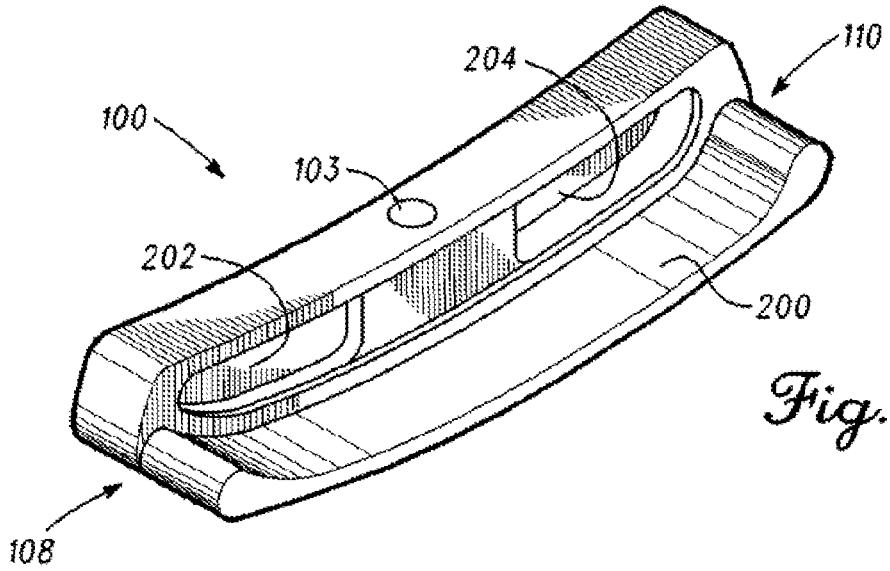
FIG. 4 is an isometric back view of the putter club head shown in FIG. 1.

Referring to FIGS. 2, 3, and 4, which depict an exemplary club head 100 as seen from various views, body 102 suitably includes two cut-outs: one cut-out 202 in heel region 108, and another cut-out 204 in toe region 110. Cut-out 204 has a volume that is greater than that of cut-out 202. The difference in cut-out volume, multiplied by the density of the material (or materials) used to manufacture body 102, substantially compensates for the difference in weight resulting from the difference in thicknesses of the toe and heel areas 110 and 108.

In the illustrated embodiment shown in FIGS. 2 and 4, cut-outs 202 and 204 have similar shapes, but have different depths. It will be appreciated, however, that the present invention is not so limited. For example, cut-outs 202 and 204 may have the same depth but different shapes, or may comprise multiple cut-outs (e.g., perforations and the like) distributed to produced the desired weight balancing.

Figure 5:
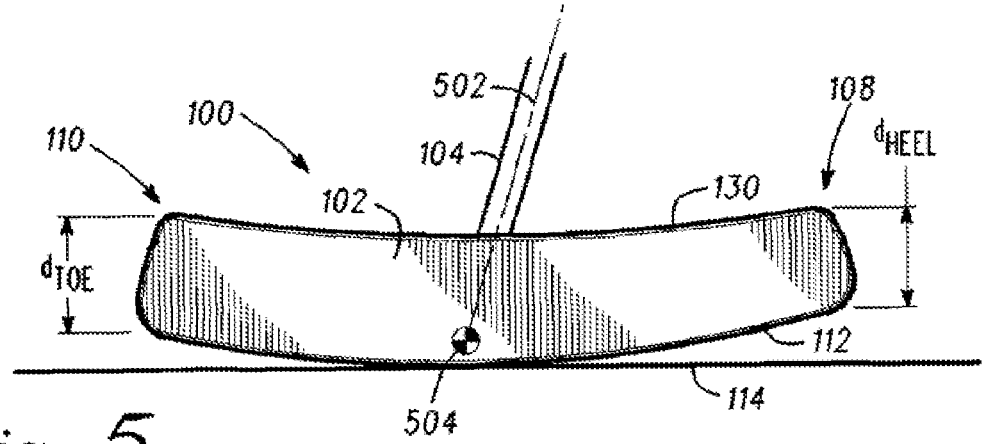
FIG. 5 is a front view of a putter club head in accordance with another aspect of the present invention.

In accordance with a further aspect of the present invention, club head body 102 is weight-compensated such that the center of gravity of the club head body substantially lies on the shaft axis. That is, referring now to FIG. 5, body 102 has a center of gravity (or center of mass) 504. The position of center of gravity 504 may be specified by changing the shape and/or composition of body 102. In the illustrated embodiment, cut-outs 202 and 204 (shown in FIG. 2) are configured such that center of gravity 504 substantially lies on axis 502 of shaft 104, or is configured such that a projection of center of gravity 504 onto a plane parallel to club head face 120 lies on a line resulting from projection of shaft axis 104 onto that same plane. Such a club head is said to be "face balanced."

Furthermore, to the extent that it is desirable to lower the center of gravity on face 120, it is advantageous for body 102 to comprise a low profile region (close to the sole) extending outwardly from the back 116 of the body 102. Such a configuration is shown in FIGS. 2, 3, and 4, which depict an exemplary low-profile region 200.

Although the invention has been described herein in conjunction with the appended drawings, those skilled in the art will appreciate that the scope of the invention is not so limited. Modifications in the selection, design, and arrangement of the various components and steps discussed herein may be made without departing from the scope of the invention as set forth in the appended claims.

What is claimed is:

1. A putter club head comprising:

a club head body having a toe, a heel, a sole having a radius of curvature, a front face;

a top surface opposite the sole, the top surface being concave and having a radius of curvature, wherein the top surface radius of curvature is greater than the sole radius of curvature;

a back opposite and parallel to the front face;

a hosel coupled to the top surface and configured to accept a shaft, wherein the shaft connects to the hosel at substantially the midpoint of the top surface, wherein the midpoint of the top surface comprises the intersection of the midpoint measured form the front face to the back, and from the toe to the heel;

wherein the toe, extending from the sole to the top surface is thicker than the heel, extending from the sole to the top surface;

a first cavity adjacent the toe that extends into the body from the back towards the front face;

a second cavity adjacent the heel that extends into the body from the back towards the front face;

wherein, the first cavity extends into the body from the back towards the front face a greater distance than the second cavity;

wherein, the first cavity has a volume greater than the volume of the second cavity;

a flange having a top flange surface and a bottom flange surface, wherein the flange extends outwardly substantially normal to the back of the body, and wherein the flange extends continuously along the length of the body, from the toe to the heel, adjacent the sole, wherein the flange comprises a variable thickness;

wherein the club head body has a center of gravity along a shaft axis defined by a hosel; and wherein the club head body at the heel is weight compensated such that the center of gravity of the club head body lies on the shaft axis.

2. The putter head of claim 1, wherein the first and second cavity have an upper cavity portion and a lower cavity portion.

3. The putter club head of claim 2, wherein the upper cavity portion has a radius of curvature substantially similar to the radius of curvature of the top surface.

4. The putter club head of claim 2, wherein the lower cavity portion has a radius of curvature substantially similar to the radius of curvature of the top flange surface.

5. The putter club head of claim 1, wherein the bottom flange surface has a radius of curvature substantially similar to the sole radius of curvature.

6. The putter club head of claim 1, wherein the flange extends outwardly from the back of the body a greater distance at the toe and the heel than the flange extends at the midpoint of the body.

7. The putter club head of claim 1, wherein the thickness of the flange is greater at the toe and heel, than at the midpoint of the body.

8. The putter club head of claim 1, wherein the hosel is a bore.

9. A putter club head comprising:

a club head body having a toe;

a heel;

a sole having a sole radius of curvature;

a front face;

a top surface opposite the sole, the top surface being concave and having a radius of curvature, wherein the top surface radius of curvature is greater than the sole radius of curvature;

a back opposite and parallel to the front face;

a hosel coupled to the top surface and configured to accept a shaft, wherein the shaft connects to the hosel at substantially a midpoint of the top surface, wherein the midpoint of the top surface comprises the intersection of the midpoint measured form the front face to the back, and from the toe to the heel;

wherein the toe that extends from the sole to the top surface is thicker than the heel that extends from the sole to the top surface;

a first cavity adjacent the toe that extends into the club head body from the back towards the front face;

a second cavity adjacent the heel that extends into the club head body from the back towards the front face;

wherein the first cavity extends into the body from the back towards the front face a greater distance than the second cavity;

the first cavity has a volume greater than a volume of the second cavity, wherein the first cavity and the second cavity have an upper cavity portion and a lower cavity portion, and the upper cavity portion has a radius of curvature substantially similar to the radius of curvature of the top surface;

wherein the club head body has a center of gravity along a shaft axis defined by a hosel; and wherein the club head body at the heel is weight compensated such that the center of gravity of the club head body lies on the shaft axis.

10. The putter club head of claim 9, further comprising a flange, having a top flange surface and a bottom flange surface, extending outwardly from the back of the body, continuously along the length of the body, from the toe to the heel, adjacent the sole, wherein the flange has a thickness extending from the sole to the bottom portion of the first cavity and second cavity.

11. The putter club head of claim 10, wherein the bottom flange surface has a radius of curvature substantially similar to the sole radius of curvature.

12. The putter club head of claim 10, wherein the thickness of the flange is greater at the toe and heel, than at the midpoint of the body.

13. The putter club head of claim 10, wherein the flange extends outwardly from the back of the body a greater distance at the toe and the heel then the flange extends at the midpoint of the body.

14. The putter club head of claim 13, wherein the top surface at the toe end comprises a greater distance from a ground plane when the club head is at an address position than the top surface at the heel end.

15. The putter club head of claim 9, wherein the lower cavity portion has a radius of curvature substantially similar to the radius of curvature of the top flange surface.

16. The putter club head of claim 9, wherein the hosel is a bore.

17. A method for manufacturing a putter club head comprising:

forming a club head body having a toe, a heel, a sole having a sole radius of curvature, a front face, a top surface opposite the sole, the top surface being concave and having a radius of curvature, greater than the sole radius of curvature, and a back opposite and parallel to the front face;

providing a hosel coupled to the top surface, wherein the hosel is configured to accept a shaft, wherein the shaft connects to the hosel at substantially a midpoint of the top surface, wherein the midpoint of the top surface comprises the intersection of the midpoint measured form the front face to the back, and from the toe to the heel;

providing the toe to extend from the sole to the top surface and to be thicker than the heel that extends from the sole to the top surface;

providing a first cavity adjacent the toe that extends into the body from the back towards the front face;

providing a second cavity adjacent the heel that extends into the body from the back towards the front face, wherein the first cavity extends into the body from the back towards the front face a greater distance than the second cavity;

providing the first cavity to have a volume greater than the volume of the second cavity; and providing a flange, having a top flange surface and a bottom flange surface, to extend outwardly from the back of the body, continuously along the length of the body, from the toe to the heel, adjacent the sole, wherein the flange has a thickness extending from the sole to the bottom portion of the first cavity and second cavity;

wherein the club head body has a center of gravity along a shaft axis defined by a hosel; and wherein the club head body at the heel is weight compensated such that the center of gravity of the club head body lies on the shaft axis.

18. The method of claim 17, further providing the first cavity and the second cavity to have an upper cavity portion and a lower cavity portion.

19. The method of claim 18, further providing the upper cavity portion to have a radius of curvature substantially similar to the radius of curvature of the top surface.

20. The method of claim 18, further providing the lower cavity portion to have a radius of curvature substantially similar to the radius of curvature of the top flange surface.

21. The method of claim 17, further providing the bottom flange surface to have a radius of curvature substantially similar to the sole radius of curvature.

22. The method of claim 17, wherein the hosel is a bore.

* * * * *

UNITED STATES PATENT AND TRADEMARK OFFICE

CERTIFICATE OF CORRECTION

PATENT NO. : 7,473,189 B2
APPLICATION NO. : 11/796671
DATED : January 6, 2009
INVENTOR(S) : Schweigert et al.

It is certified that error appears in the above-identified patent and that said Letters Patent is hereby corrected as shown below:

Column 4, Line 14 (Claim 1), delete "form" and insert --from-- after the text reading "the midpoint measured"

Column 4, Line 40 (Claim 2), insert --club-- after the text reading "The putter"

Column 4, Line 40 (Claim 2), delete "and" and insert --cavity and the-- after the text reading "wherein the first"

Column 5, Line 10 (Claim 9), delete "form" and insert --from-- after the text reading "the midpoint measured"

Column 5, Line 48 (Claim 13), delete "then" and insert --than-- after the text reading "at the toe and the heel"

Column 6, Line 8 (Claim 17), delete "," after the text reading "having a radius of curvature"

Column 6, Line 16 (Claim 17), delete "form" and insert --from-- before the text reading "the front face to the back,"

Signed and Sealed this

Sixth Day of April, 2010

David J. Kappos

David J. Kappos
*Director of the United States Patent and Trademark Office*